US006174216B1

(12) United States Patent
Chianese

(10) Patent No.: US 6,174,216 B1
(45) Date of Patent: Jan. 16, 2001

(54) STRETCHABLE TWO-HEADED TOY FIGURE

(75) Inventor: Stephen Chianese, Hermosa Bch, CA (US)

(73) Assignee: Mattel, Inc., El Segundo ( * ) Notice: Under 35 U.S.C. 154(b), the term of this patent shall be extended for 0 days.

(21) Appl. No.: 09/366,164

(22) Filed: Aug. 3, 1999

(51) Int. Cl.[7] ..... A63H 3/36; A63H 3/46

(52) U.S. Cl. ..... 446/320; 446/380; 446/385; 446/486

(58) Field of Search ..... 446/370, 373, 446/385, 486, 311, 369, 309, 379, 380; 482/121, 122, 126

(56) References Cited

U.S. PATENT DOCUMENTS

| | | | | |
|---|---|---|---|---|
| 163,957 | * | 6/1875 | Wood | 482/121 |
| 1,644,027 | * | 10/1927 | O'Neill | 446/373 |
| 3,601,923 | | 8/1971 | Rosenberg . | |
| 3,645,038 | | 2/1972 | Morrison et al. . | |
| 4,169,336 | | 10/1979 | Kuhn . | |
| 4,206,568 | | 6/1980 | Garner . | |
| 4,219,959 | | 9/1980 | Fleischer . | |
| 4,236,347 | | 12/1980 | Fauls . | |
| 4,268,991 | | 5/1981 | Cotey et al. . | |
| 4,583,957 | | 4/1986 | Levy . | |
| 4,618,213 | | 10/1986 | Chen . | |
| 4,666,417 | | 5/1987 | Hillman . | |
| 4,846,757 | | 7/1989 | McMurray . | |
| 4,929,211 | | 5/1990 | Resnick et al. . | |
| 4,952,190 | | 8/1990 | Tarnoff et al. . | |
| 4,968,281 | | 11/1990 | Smith et al. . | |
| 5,162,012 | | 11/1992 | Blandi et al. . | |
| 5,194,033 | | 3/1993 | Wright . | |
| 5,205,803 | * | 4/1993 | Zemitis | 482/121 |
| 5,338,245 | | 8/1994 | Murza et al. . | |
| 5,395,278 | | 3/1995 | Dickhut . | |
| 5,498,190 | | 3/1996 | Ganson . | |
| 5,516,322 | | 5/1996 | Myers . | |
| 5,518,436 | | 5/1996 | Lund et al. . | |
| 5,520,566 | | 5/1996 | Lin . | |
| 5,522,756 | | 6/1996 | Barthold . | |
| 5,624,294 | | 4/1997 | Chen . | |
| 5,630,745 | | 5/1997 | Yeh . | |
| 5,695,380 | | 12/1997 | Morrison . | |
| 5,727,984 | | 3/1998 | Lin . | |

* cited by examiner

*Primary Examiner*—D. Neal Muir
(74) *Attorney, Agent, or Firm*—Roy A. Ekstrand

(57) ABSTRACT

A resilient elastic toy figure body supports a quartet of downwardly extending legs and a pair of heads outwardly facing from each end of the toy figure body. The stretchy elastic material body defines an interior cavity within which a particulate filler is captivated. Each head is securely attached to its respective end of the toy figure body. A relatively inelastic limiter cord is secured to each head and passes through the particulate filler of the toy figure body. As the stretchable body is elongated during play activity, the limiter cord reaches its full extension and further elongation which might damage the toy figure is prevented.

5 Claims, 2 Drawing Sheets

STRETCHABLE TWO-HEADED TOY FIGURE

CROSS REFERENCE TO RELATED APPLICATION

This application is related to a co-pending application entitled EXPANDABLE TWO-HEADED TOY FIGURE filed and having Ser. No. 09/366,162 filed Aug. 3, 1999 which is assigned to the assignee of the present application.

FIELD OF THE INVENTION

This invention relates generally to dolls and toy figures and particularly to those which undergo size and/or shape changes during their play patterns.

BACKGROUND OF THE INVENTION

Toy figures and dolls as well as other hand-held or hand manipulated toys which change shape or size are well known in the art. Such shape or size changing toys achieve their play action using a variety of structures, mechanisms and materials combinations.

One type of shape and/or size changing toy may be generally characterized by its flexible and stretchable deformable outer skin and amorphous material filling. For example, U.S. Pat. No. 4,169,336 issued to Kuhan sets forth a STRECHABLE FIGURE EXHIBITING SLOW RECOVERY having an outer skin formed of an elastic film material which is filled with a high viscosity material. The figure is formed to generally resemble a human and the material filling exhibits a sufficient high viscosity to impede the recovery of normal shape when the outer skin is stretched. Thus the toy figure may be stretched dramatically and released and thereafter very slowly returns to its normal shape.

U.S. Pat. No. 4,236,347 issued to Fauls set forth a FLEXIBLE DOLL CLOSURE AND HEAD MOUNTING having an elastic material skin and viscous liquid filler. The head portion of the doll body is removable from the remainder of the doll body by a unique closure and attachment which seals the doll body interior and captivates the viscous liquid.

U.S. Pat. No. 3,601,923 issued to Rosenburg sets forth an AMUSEMENT DEVICE EMPLOYING DILATANT SUSPENSION FILLER having an impervious elastic container in a desired configuration and a dilatant suspension enclosed therein. The toy exhibits unusual distortion and recovery of shape properties and may be fabricated in a variety of shapes and sizes.

U.S. Pat. No. 4,952,190 issued to Tarnoff et al. sets forth a DEFORMABLE ARTICLE having a flexible bladder assuming a desired shape and having a filling stem for receiving a moldable filling medium such as a cohesive mixture of hollow or solid microspheres and water.

U.S. Pat. No. 5,516,322 issued to Myers sets forth LIQUID FILLABLE TRANSPARENT DOLLS formed of a plurality of hollow relatively movable body parts which are interconnected to form a common reservoir therein. A liquid fills the reservoir and provides color imparted to the outer appearance of the doll.

U.S. Pat. No. 4,968,281 issued to Smith et al. sets forth a TOY ANIMAL WITH SUPPLE LEGS AND WEIGHTED FEET formed of a outer flexible skin within which a plurality of beads are confined. Within the lower legs and feet of the toy figure a mass of relatively heavy beads are concentrated to insure the upright standing position of the animal toy.

U.S. Pat. No. 5,338,245 issued to Murza et al. and U.S. Pat. No. 5,518,436 issued to Lund et al. as well as U.S. Pat. No. 4,846,757 issued to McMurray each show examples of deformable bladder type toys having a liquid or flowing interior filling.

In a related type of shape and/or size changing toy the structure is characterized by one of more expandable elements such as limbs which utilize mechanical apparatus for achieving the expansion or extension. For example, U.S. Pat. No. 3,645,038 issued to Morrison et al. sets forth FIGURE TOYS having one or more portions formed of corrugated plastic tubing which is capable of being contracted and expanded in length and is capable of being curved into an arch. The tubing is formed by providing a series of hinge sections along its length defining a continuous series of groves having sides of unequal length. The unequal sides are coupled by hinge sections which eliminate elasticity between the connected sections.

U.S. Pat. No. 4,583,957 issued to Levy sets forth PNEUMATICALLY-OPERATED ROBOTIC TOY having an internal bellows or air pump which forces pressurized air to flow from the internal pump through passage ways into hollow arms of the robot. The arms of the robot include bellows which expand as the pressure within the arm is increased and which contract as the pressure therein is reduced.

U.S. Pat. No. 5,162,012 issued to Blandi et al. sets forth a MUSICAL PULL STRING TOY having an elongated body supported by an upper hook and defining a multiply pleated mid-section. The mid-section is expandable as the lower end of the toy is pulled downwardly. A string extends through the toy and is operative as the toy is stretched downwardly to wind a spring driven music producing mechanism in the toy.

U.S. Pat. No. 5,194,033 issued to Wright sets forth a PROJECTABLE TOY STUFFED ANIMAL having a body defining a flexible outer layer and an elongate tail projecting rearwardly from its trunk. The tail is provided with a plurality of annular folds which allow it to be extended. An elastic element within the toy body provides a spring like extension of the toy.

U.S. Pat. No. 4,206,568 issued to Garner sets forth JOINED DOLLS having a pair of flexible padded dolls each defining pairs of leg and arm appendages. The end portions of the doll leg and arm appendages of each doll are joined.

U.S. Pat. No. 5,395,278 issued to Dickhut sets forth a MANUALLY MANIPULATABLE FLEXIBLE TOY having an elongated tube fabricated of semi-rigid material such as plastic. The tube forms bellows which in turn define a plurality of larger diameter rings and a plurality of smaller diameter rings joined in an alternating array length wise on the tube by frusto-conical walls. The tube is as a result, extendible, retractable and readily formed into various curved configurations.

Other generally related toys and toy figures share various characteristics and/or structures with the foregoing described prior art devices. For example, U.S. Pat. No. 4,219,959 issued to Fleischer sets forth a TOY EGG adapted for pulling, stretching and bouncing which includes a pair of intertwined helicly cut shells.

U.S. Pat. Nos. 5,727,984 issued to Lin and 4,666,417 issued to Hillman set forth elongated expandable toys having elongated bodies and providing novelty amusement devices.

A number of other patents show toy and toy items generally related to shape or size changing toys. U.S. Pat.

No. 4,268,991 issued to Kotey et al. and U.S. Pat. No. 5,520,566 issued to lin, and U.S. Pat. No. 5,630,745 issued to Yea are examples of such patents. Additional patents show items generally related to shape changing toys such as U.S. Pat. No. 5,624,294 issued to Chen and U.S. Pat. No. 5,498,190 issued to Ganson and U.S. Pat. No. 5,522,756 issued to Barthold as well as U.S. Pat. No. 4,929,211 issued to Rensick et al. and U.S. Pat. No. 5,695,380 issued to Morrison and U.S. Pat. No. 4,618,213 issued to Chen.

While the foregoing described prior art toys, toy figures and dolls have generally improved the toy art and in some instances enjoyed commercial success, there remains nonetheless a continuing need in the art fore evermore improved dolls and toy figures having changing shapes and/or sizes.

SUMMARY OF THE INVENTION

Accordingly, it is a general object of the present invention to provide an improved stretchable toy figure. It is a more particular object of the present invention to provide an improve an improved stretchable toy figure which is entertaining and amusing to use and which is extremely and rugged and durable in construction and able to take substantial stress and abuse.

In accordance with the present invention there is provided a stretchable toy figure comprising: a body having an elastic skin defining opposed ends and an interior cavity; a quantity of particulate filler filling the interior cavity; a pair of heads each secured to the opposed ends; and a limiter cord having a pair of ends each coupled to one of the heads, the cord extending through the interior cavity between the opposed ends of the body, the body assuming a relaxed shape and being stretchable to an elongated shape and the limiter cord having a length limiting the elongated shape to a predetermined elongation.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
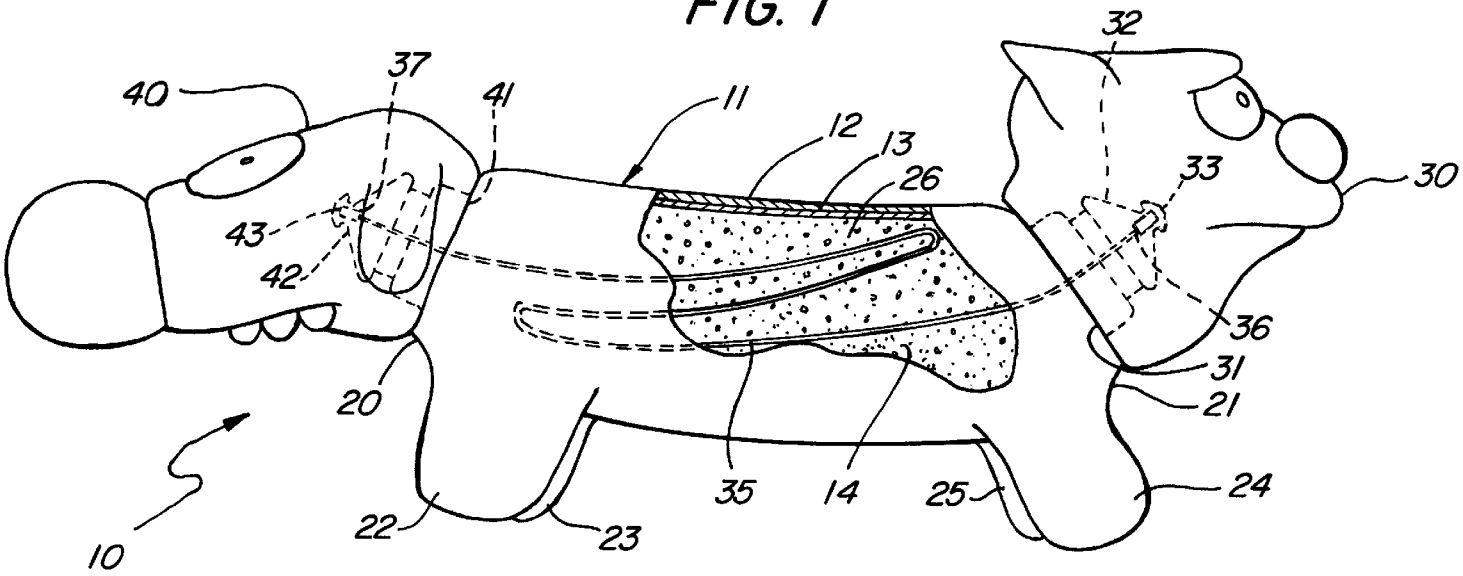
FIG. 1 sets forth a partially section side elevation view of a stretchable toy figure constructed in accordance with the present invention in its relaxed or natural state.

FIG. 1 sets forth a partially sectioned side elevation view of a stretchable toy constructed in accordance with the present invention and generally referenced by numeral 10. Toy 10 includes a flexible body 11 formed of an outer skin 12 and an inner skin 13. Outer skin 12 and inner skin 13 are preferably fabricated of a resilient stretchable material such as plastic or rubber or the like. Inner skin 13 fits within outer skin 12 and generally conforms to the shape of outer skin 12. To prevent skin 12 from sticking or adhering to skin 13, a dry material such as talc is dusted between inner skin 13 and outer skin 12. Body 11 is fabricated to generally resemble a four-legged animal and thus defines downwardly extending legs 22, 23, 24 and 25. Body 11 further defines ends 20 and 21 on each end thereof. Inner skin 13 defines an interior cavity 14 within which a quantity of loose particulate filler 26 is received. Filler 26 is preferably fabricated of a quantity of small particulate or granular elements and is preferably dry and free of liquid. In the preferred fabrication of the present invention, filler 26 comprises a large number of small plastic spheres having diameters of approximately one half millimeter. It will be apparent to those skilled in the art however that filler 26 may be virtually any granular or particulate material. In addition, filler 26 may be replaced by a combination of particulate materials and liquid or alternately a viscous fluid may be used for filler 26.

Toy 10 further includes a head 30 supported upon body 11 at end 21 and a head 40 supported upon body 11 at end 20. In the embodiment of the present invention set forth in FIG. 1, heads 30 and 40 are fabricated to generally resemble fanciful depiction's of a cat and a dog respectively. However, it will be apparent to those skilled in the art that heads 30 and 40 may be fabricated to resemble other animals or creatures or even human-like figures without departing from the spirit and scope of the present invention.

Head 30 is fabricated of a relatively rigid resilient plastic material and defines a neck 31. By means set forth below in FIG. 3 in greater detail head 30 is secured at neck 31 to end 21 of body 11 utilizing a plug 32. Plug 32 supports an anchor 33 joined to an end 26 of a limiter cord 35. Limiter cord 35 comprises a flexible relatively strong cord loosely looped within filler 26 of body 11. Limiter cord 35 further defines an end 37 joined to an anchor 43.

Head 40 is preferably fabricated of a relatively rigid resilient material such as molded plastic or the like and defines a neck portion 41. By means set forth below in greater detail, a plug 42 is received within neck 41 and secures anchor 43 within head 40. The attachment of plug 42 within head 40 as well as the attachment of plug 32 within head 30 are set forth below in FIG. 3 in greater detail. However, suffice it to note here that plug 32 cooperates with neck 31 of head 30 to secure end 36 of cord 35 while plug 42 to similarly cooperates with neck 41 to secure end 37 of cord 35 within head 40. In addition, head 30 and head 40 are secured to ends 21 and 20 respectively of body 11 by the attachment set forth below in FIG. 3. The resulting structure provides a flexible body 11 having a filler 26 supported and confined therein together with a pair of oppositely positioned heads 30 and 40 each respectively secured to body 11 in a fixed attachment.

In operation, the flexible character of body 11 and the interacting cooperation of outer skin 12, inner skin 13 and filler 26 provide various play activities in which the pliant character of body 11 allows the figure to be variously twisted, pulled, stretched and deformed as desired. With toy FIG. 10 in the relaxed position shown in FIG. 1, limiter cord 35 loosely couples plugs 32 and 42 and is not placed intention.

Figure 2:
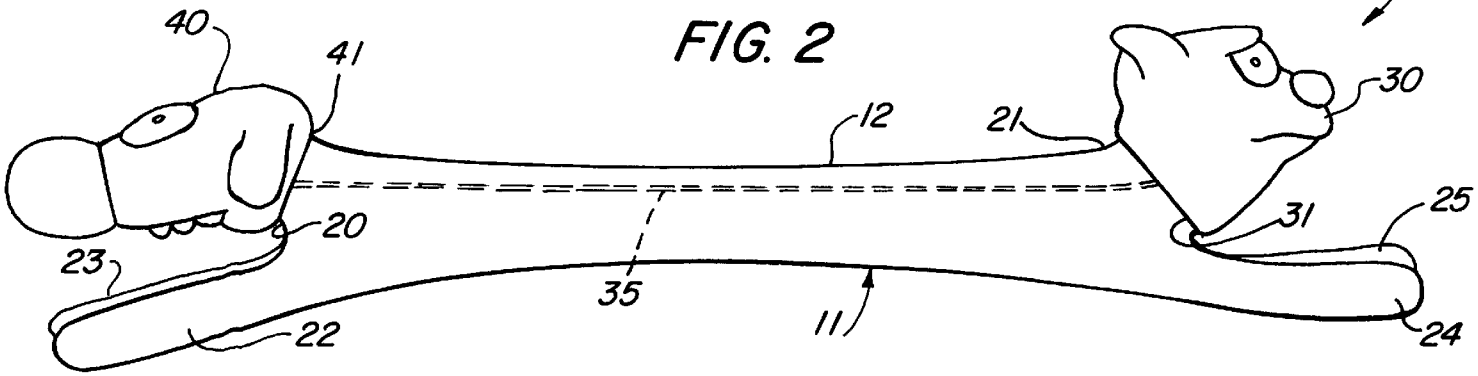
FIG. 2 sets forth the present invention stretchable toy figure in its stretched or extended state.

In accordance with one anticipated play pattern of the present invention toy figure however, heads 30 and 40 are drawn apart stretching body 11 into the more elongated shape shown in FIG. 2. In accordance with an important aspect of the present invention, the elongation of body 11 during such play activities draws limiter cord 35 away from its loosely looped relaxed position shown in FIG. 1 toward the taught extension shown in FIG. 2. The secure attachment of ends 36 and 37 of limiter cord 35 together with cooperating anchors 33 and 43 within plugs 32 and 42 causes limiter cord 35 to limit the extension or stretching of body 11. Since the user is unable to further stretch heads 32 and 42 apart, once limiter cord 35 is extended its full length and is subjected to a tension stress, further elongation of body 11 is prevented. As a result, the user is prevented from over stressing body 11 and from damaging toy FIG. 10. Once the user releases the stretching force imposed upon body 11, the elasticity of outer skin 12 and inner skin 13 causes body 11 to slowly contract and redistribute filler 26 as body 11 returns to the relaxed of normal state shown in FIG. 1.

FIG. 2 sets forth a side elevation view of toy FIG. 10 in the above described stretched position. As described above, toy FIG. 10 includes a body 11 having an outer skin 12 and defining legs 22 through 25. Body 11 further defines ends 20 and 21 which receive heads 40 and 30 respectively in the manner set forth below in FIG. 3. Head 30 includes a neck 31 joined to end 21 while head 40 includes a neck 41 joined to end 20. As described above, a limiter cord 35 extends between plugs 32 and 42 (seen in FIG. 1).

In the elongated position of body 11 shown in FIG. 2, the outward relative movements of heads 30 and 40 has drawn limiter cord 35 to the full extension shown in FIG. 2. Further tension placed between heads 30 and 40 is resisted by limiter cord 35 which in its preferred fabrication is relatively in elastic and thus is able to resist further outward extension of body 11. In this manner, toy FIG. 10 is fully protected from excessive stretching which would otherwise potentially tare or otherwise damage either outer skin 12, inner skin 13 (seen in FIG. 1) or cause damage to the attachments of heads 30 and 40 to ends 21 and 20 respectively.

Once the extending forces imposed upon toy FIG. 10 are released, the elastic character of outer skin 12 and inner skin 13 (seen in FIG. 1) cause body 11 to contract toward the relaxed position shown in FIG. 1. The presence of the particulate filler within body 11 (filler 26 shown in FIG. 1) resists and slows this contraction causing toy FIG. 10 to return to the relaxed position of FIG. 1 in a very slow process. Once body 11 begins contracting, the tension imposed upon limiter cord 35 is relaxed and limiter cord 35 is carried within interior cavity 14 (seen in FIG. 1) by the movement of filler particles therein.

Figure 3:
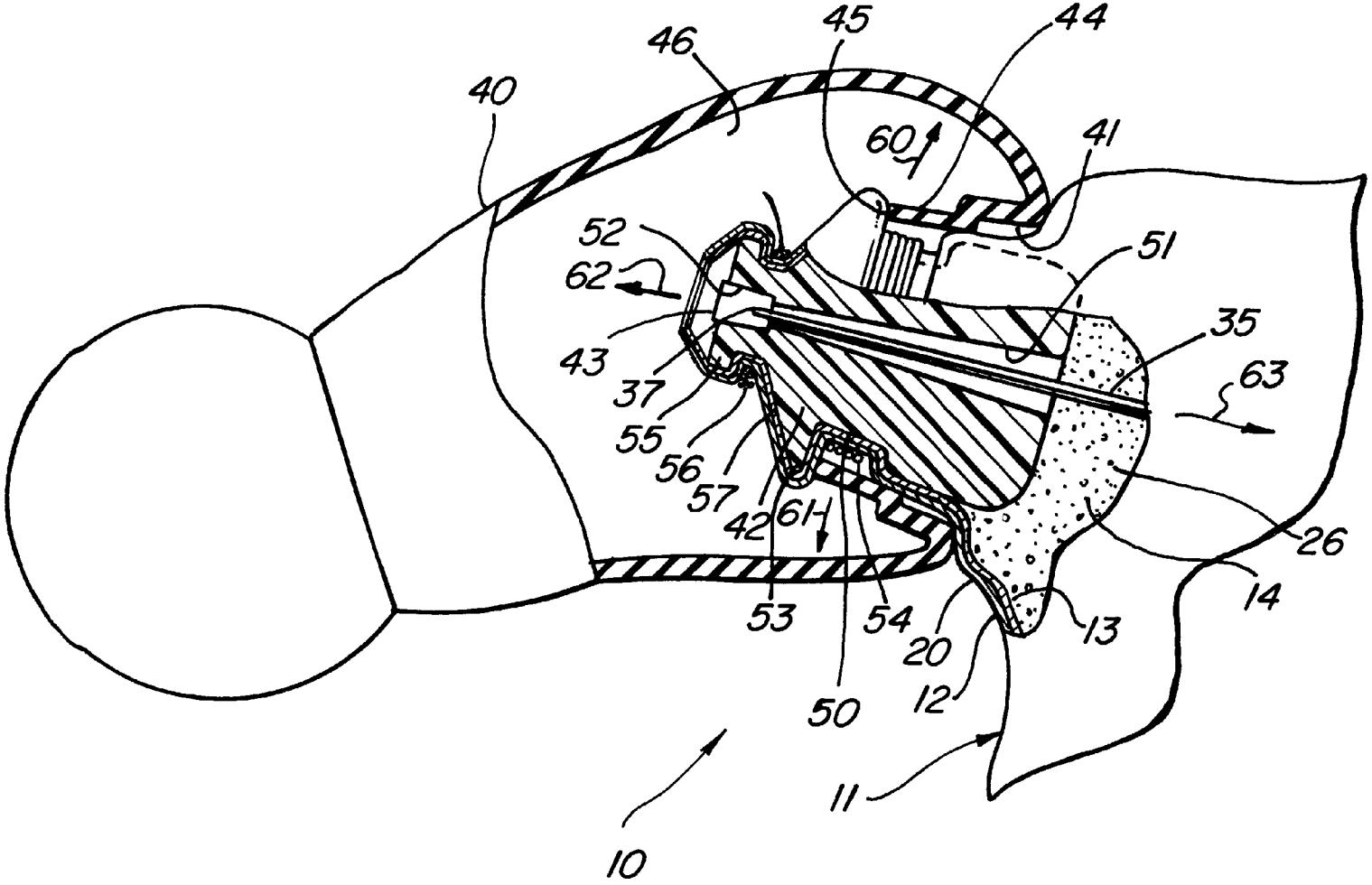
FIG. 3 sets forth a partial section view of the head attachment structure of the present invention stretchable toy figure.

FIG. 3 sets forth a partial section view of toy FIG. 10 showing the attachment of head 40 to body 11 and the attachment of limiter cord 35 in greater detail. At the outset, it will be understood that plug 32 (seen in FIG. 1) which secures head 30 is identical to plug 42 shown in FIG. 3. Further, the structure of neck 31 of head 30 and end 21 of body 11 (both seen in FIG. 1) is further identical to the structure of neck 41 of head 40 and end 20 of body 11 shown in FIG. 3. Thus it will be understood that the attachment and structure shown in FIG. 3 which secures head 40 to body 11 is equally descriptive of the structure and attachment which secures head 30 to body 11.

More specifically, toy FIG. 10 includes a body 11 formed of an outer skin 12 and an inner skin 13 to define an interior cavity 14. Interior cavity 14 receives a quantity of particulate filler material 26. Outer skin 12 and inner skin 13 define generally tapered ends 20 which receive a plug 42. Plug 42 is preferably formed of a rigid material such as molded plastic or the like and is inserted into end 20 of body 11. Plug 42 defines a central passage 51 and a receptacle 52 continuous therewith. An anchor 43 receives and secures end 37 of limiter cord 35 and is in turn secured within receptacle 52 of plug 42. Plug 42 further defines a groove 50 and a collar 53. Collar 53 defines a angled surface 57 extending away from groove 50. Plug 42 further defines an outwardly extending flange 55 which encircles receptacle 52.

As mentioned above, end 20 of outer skin 12 and inner skin 13 is received upon plug 42. A quantity of cord 54 is wrapped upon outer skin 12 within groove 50 securing outer skin 12 and inner skin 13 to plug 42. In addition, a second quantity of cord 56 is wrapped about plug 42 upon outer skin 12 to further secure outer skin 12 and inner skin 13 between flange 55 and angled surface 57. The resulting attachment provided by plug 42 and cords 54 and 56 securely attaches end 20 of body 11 to plug 42 and seals interior cavity 14.

Head 40 defines an interior cavity 46 and a neck return 44 extending into cavity 46 from neck portion 41 of head 40. Neck return 44 defines an edge 45. As mentioned above, head 40 is preferably fabricated of a relatively rigid resilient plastic material such as molded plastic or the like. In the assembly of body 11 to head 40, plug 42 is inserted into end portion 20 of outer skin 12 and inner skin 13 after which cords 54 and 56 are wound and secured. Once plug 42 is secured to end 20 of body 11 in this manner, limiter cord 35 and anchor 43 is secured within passage 51 and receptacle 52. The combined structure is thereafter is assembled to head 40 by forcing plug 42 through neck 41 and neck return 44. During this insertion, angled surface 57 cooperates with neck return 44 causing it to expand outwardly in the manner indicated by arrows 60 and 61 until collar 53 passes beyond edge 45. Once edge 45 clears collar 53, the resilient character of neck return 44 contracts the neck return beneath collar 53 in the manner shown in FIG. 3. As a result, plug 42 is captivated within interior cavity 46.

As mentioned above, it will be understood that the attachment and assembly of plug 32 within head 30 (seen in FIG. 1) is carried forward in the identical manner to that shown and described for plug 42 within head 40. Thus once heads 30 and 40 are assembled to body 11, toy 10 is complete and assumes the fabrication shown in FIG. 1.

What has been shown is a two-headed stretchable toy figure which utilizes a resilient body having a stretchable outer skin filled with a particulate filler material. A pair of heads are positioned on each side of the toy figure and the resulting toy is capable of a variety of play patterns. Damage to the toy which would otherwise occur from excessive stretching or elongation of the toy body is prevented by an internally supported limiter cord secured to each head of the toy figure.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A stretchable animal toy figure comprising:

a body having an elongated generally tubular portion defining opposed ends, a pair of oppositely facing toy animal body portions joined to said opposed ends each having pair of front legs and a neck end and an interior cavity, said elongated generally tubular and said pair of toy animal body portions being formed of an elastic skin;

a quantity of particulate filler filling said interior cavity;

a pair of toy animal heads each secured to one of said neck ends; and a generally inelastic limiter cord having a pair of ends each coupled to one of said toy animal heads, said cord extending loosely through said interior cavity between said toy animal heads, said body and toy animal body portions assuming a relaxed shape in which said heads face outwardly and being stretchable to an elongated shape by drawing said heads apart and said limiter cord having a length limiting said elongated shape to a predetermined elongation.

2. The stretchable toy figure set forth in claim 1 wherein said elastic skin is formed of an outer skin and generally conforming inner skin.

3. A stretchable toy figure comprising:

a stretchable toy animal body having a body defining a pair of outwardly facing toy animal head, neck and front legs and a connecting body portion and an interior cavity having a filler therein, said toy animal body being stretchable between a relaxed shape and an elongated shape; and a limiter cord having a pair of ends coupled to said heads and passing through said interior cavity, said limiter cord having a length sufficient to allow said limiter cord to be slack when said body is in said relaxed shape and being drawn into tension when said body is stretched to said elongated shape by drawing said head, neck and front legs apart.

4. The stretchable toy figure set forth in claim 3 further including a pair of plugs secured to said opposed ends of said limiter cord and wherein said plugs are received within said pair of heads.

5. The stretchable toy figure set forth in claim 4 wherein said ends of said limiter cord are attached to said plugs.

* * * * *